US006813910B2

(12) United States Patent
Sangiacomo

(10) Patent No.: US 6,813,910 B2
(45) Date of Patent: Nov. 9, 2004

(54) DEVICE FOR VARYING THE LENGTH OF STITCHES ON CIRCULAR KNITTING AND HOSIERY MACHINES

(75) Inventor: Fulvio Sangiacomo, Brescia (IT)

(73) Assignee: Sangiacomo S.p.A., Brescia (IT)

( * ) Notice: Subject to any disclaimer, the term of this patent is extended or adjusted under 35 U.S.C. 154(b) by 0 days.

(21) Appl. No.: 10/611,073

(22) Filed: Jul. 1, 2003

(65) Prior Publication Data

US 2004/0007027 A1 Jan. 15, 2004

(30) Foreign Application Priority Data

Jul. 3, 2002 (IT) ..... BS 2002 A 000062

(51) Int. Cl.[7] ..... D04B 9/00
(52) U.S. Cl. ..... 66/27; 66/55
(58) Field of Search ..... 66/57, 27, 8, 54, 66/55, 56

(56) References Cited

U.S. PATENT DOCUMENTS 3,757,538 A * 9/1973 Martinetz ..... 66/19
4,718,256 A * 1/1988 Lonati ..... 66/95
5,275,020 A * 1/1994 Scherzinger ..... 66/27
6,131,417 A * 10/2000 Plath et al. ..... 66/19

* cited by examiner

*Primary Examiner*—Danny Worrell
(74) *Attorney, Agent, or Firm*—McGlew and Tuttle, P.C.

(57) ABSTRACT

The invention concerns a device for varying the length of stitches on circular hosiery and knitting machines, which includes means for rigidly anchoring the cylinder to the cylinder support, vertical guide means of the sinker bed with respect to the cylinder, and means for changing the height of the sinker bed to several positions between the two lowered and raised limit positions, in order to vary the level of the stitch formation plane defined by the sinkers in relation to the needles on the cylinder that remain in a fixed position. The invention involves also a circular knitting machine incorporating such a device.

10 Claims, 2 Drawing Sheets

DEVICE FOR VARYING THE LENGTH OF STITCHES ON CIRCULAR KNITTING AND HOSIERY MACHINES

FIELD OF THE INVENTION

This invention concerns circular knitting and hosiery machines in general and refers in particular to a device for varying the stitch length on said machines.

STATE OF THE TECHNIQUE

As it is well known, circular knitting and hosiery machines basically comprise:

- a rotating cylinder with a cylinder-support having a plurality of longitudinal grooves in which are housed and move vertical needles governed by rising and lowering cams positioned on a hood around the cylinder.
- a sinker bed placed around the top of the cylinder, turning with the same and holding a number of horizontal sinkers which radially alternate with the vertical needles on the cylinder and which together form a formation plane of the stitches on the basis of the rising and lowering of the needles, and
- a possible dial bed placed coaxially above the cylinder and housing other fixtures, such as hooks or horizontal needles used in forming different types of stitches.

These machines are also equipped, among other things, with means for varying the lengths of the stitches according to needs.

According to a known technique, one of the known ways for varying the length of the stitches is to move and position the height of the cylinder in relation to the cylinder support and stitch formation plane defined by the sinkers, on the sinker bed changing by this means the level of the needles in respect to the sinkers.

This methods however, involves for the presence of vertical guides between the cylinder support and cylinder and moving the whole cylinder mass. The cylinder support must in this case have size sufficient to easily support the cylinder in all its positions and precision work requirements so as to avoid out of center coupling with the cylinder. Furthermore, the change in height level of the cylinder requires a lifting group capable of developing a relatively strong force, compatible with the cylinder mass itself.

Then, as is well known, the needles are controlled by selection groups through jacks working in conjunction with them. The jacks move upwards in unison with the upward movements of the cylinder, with the result that they vary their level compared with the selection groups, which remain at a fixed height, and jeopardize the selection system. At present, to avoid this drawback, means for maintaining a fixed level are associated with the jacks which, notwithstanding the upward movements of the cylinder, work in conjunction with the selection groups. These means however imply further complications and added costs.

OBJECTS AND SUMMARY OF THE INVENTION

One object of the invention is to remove the drawbacks and disadvantages of the known technique and consequently be able to vary the stitch length of circular hosiery and knitting machines, without having to move the rotating cylinder mass.

Another object of the invention is to provide a device which enables the variation in the stitch length to be carried out on the machines in question by moving upwards a less cumbersome organ, improving at the same time the coupling conditions between the cylinder support and the cylinder.

These objectives are achieved, in accordance with the invention, on the one hand by keeping the height of the cylinder with the needles fixed and, on the other, by changing the height of the sinker bed in respect to the cylinder so as to vary the level of the stitch formation plane defined by said sinkers.

So, and advantageously, the cylinder can be, and remain, physically axed to the cylinder support, a condition which reduces the out of center problems of coupling between two units and in the rotation of the cylinder. Then, since the cylinder remains at a fixed height, the jacks no longer require any means to hold then always at the same level as the selection groups, with obvious advantages at least from an economic viewpoint. In addition, by remaining at a fixed height, the cylinder no longer requires vertical guides, the cylinder support implies less mechanical workings, and be at a more limited height, therefore lighter, without however compromising the rigidity of the two coupled units. Furthermore, the changes in height of only the sinkers certainly requires less driving force drive as would otherwise be necessary to change the height of all the cylinder and consequently a simpler and more economic lifting units.

BRIEF DESCRIPTION OF THE DRAWINGS

Further details of the invention will become evident in the continuation of this description made in reference to the enclosed, indicative and non-limiting drawings, in which.

DETAILED DESCRIPTION OF THE INVENTION

Figure 1:
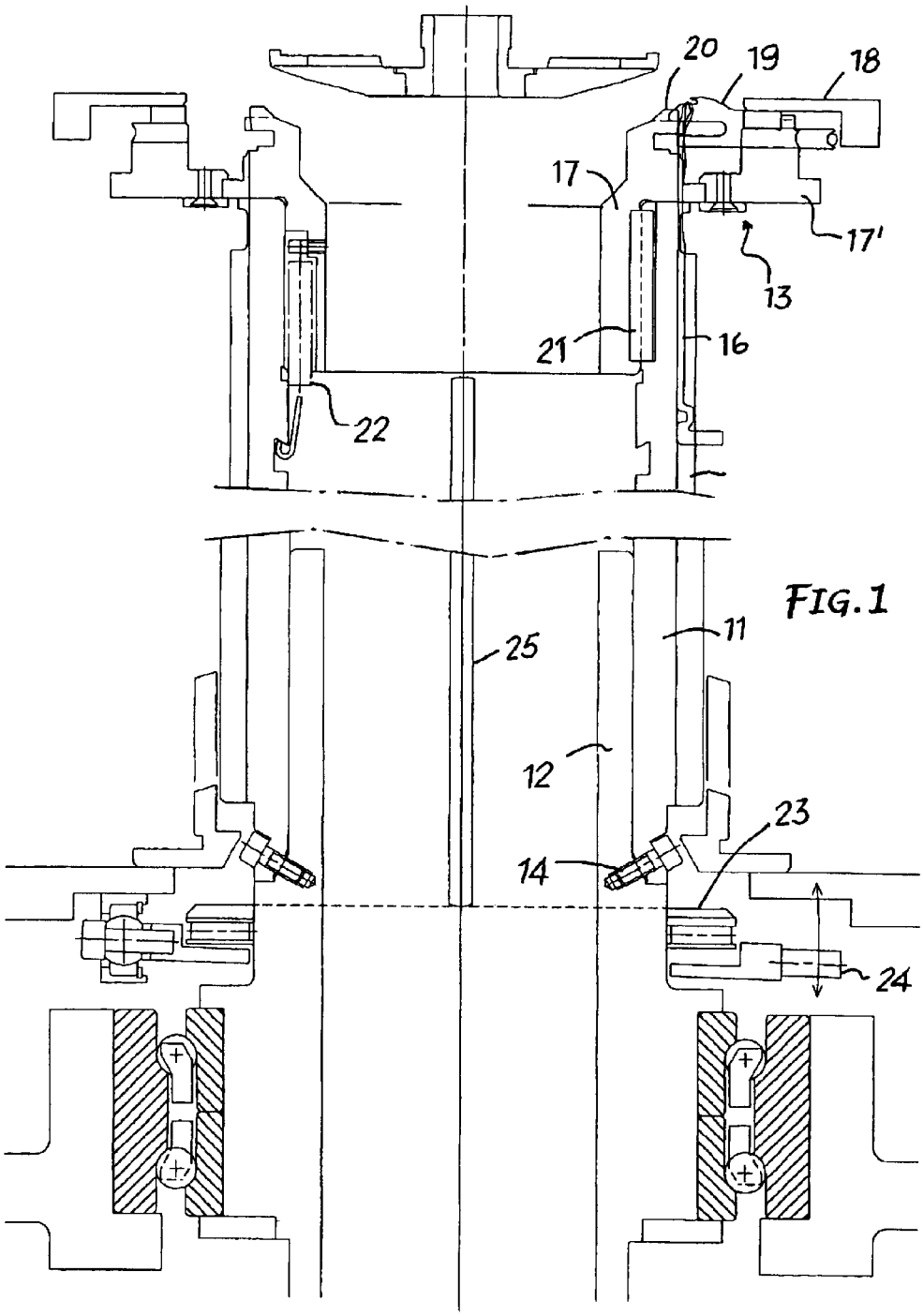
FIG. 1 shows a vertical section of the cylinder support, cylinder and sinker bed group, with the latter in a lowered position.
Figure 2:
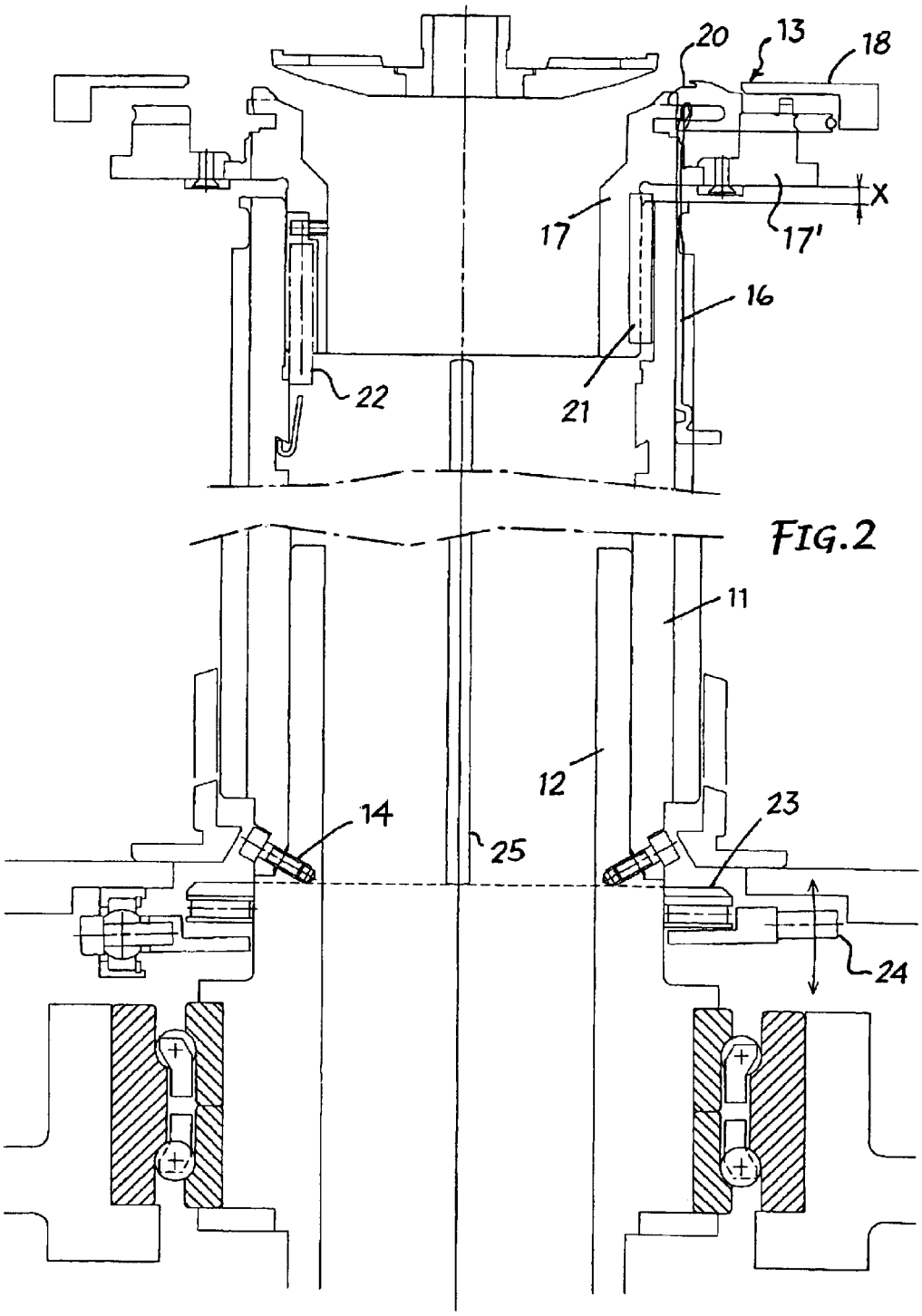
FIG. 2 shows the same section view of the group but with the sinker bed in a raised position.

In said drawings of a circular hosiery and knitting machine there is represented a cylinder 11 associated, at the bottom, with a cylinder support 12 and, at the top, with a sinkers bed 13. Cylinder 11 and the cylinder support 12 are joined together, for example, by screws 14; the cylinder support 12 is driven, as is known, to turn on its axis, causing at the same time the cylinder to turn; the sinkers bed 13 is attached to the cylinder 11 so as to turn with it.

The cylinder 11 holds around its perimeter a number of needles 16 in an equal number of longitudinal grooves 15, the rising and lowering of such needles being controlled in the usual way and the hooks of which are at the same level as the sinker bed.

The sinker bed 13 is made up of an internal crown 17, an external crown 17' and a cover 18 which together support a number of sinkers 19 which alternate with the needles, are oriented and move radially from the outside towards the inside of the cylinder and define a formation plane 20 of the stitches consequent to the rising and lowering movements of the needles during knitting of the thread or threads feed to the needles themselves.

The internal crown 17 is radially fixed to the cylinder 11 by means of keys 21 to enable the sinker bed 13 to turn together with cylinder and, at the same time, the axial movements of the sinker bed between two limit positions within the range of a set gap X, lowered and raised, with respect to the cylinder. As an alternative to the vertical guide means of the internal crown, that is the sinker bed, the needles themselves on the cylinder could be used.

As can be seen in the drawings, return springs 22 are fixed to the crown internal 17, so as to maintain or make the sinker bed return to the lowered position. To raise the sinker ring to different levels within the range of an gap X any appropriate command system can be chosen and used. In the example in the drawing, the command system consists of a ring 23 placed around the cylinder support, which can be moved upwards by a lever actuator 24 or something similar means engaging with the sinker bed, or better the crown 17, by means of thrust struts 25.

Therefore, by conveniently raising or lowering only the sinker bed with respect to the cylinder it is possible to change the level of the formation plane defined by the sinkers in relation to the needles, being able in this way to vary correspondingly, the length of the stitches to be made.

What is claimed is:

1. A device for varying the length of the stitches on circular hosiery and knitting machines, the device comprising:

a rotating cylinder with a cylinder holder, the rotating cylinder being provided with a number of longitudinal grooves;

needles housed respectively in said longitudinal grooves and moving vertically;

rising and lowering cams positioned on a hood around the cylinder to govern the movement of the needles;

a sinker bed placed around the top of the cylinder, turning with the cylinder and holding a number of horizontal sinkers which radially alternate with the vertical needles on the cylinder and which together constitute a formation plane of the stitches on the basis of the rising and lowering of the needles;

anchoring means for a rigid anchoring of the cylinder to the cylinder holder;

vertical guide means for guiding the sinker bed with respect to the cylinder; and adjusting means for changing the height of the sinker bed to several positions between two, lowered and raised, limit positions, so as to vary the level of the stitch formation plane in relation to the needles on the cylinder.

2. A device according to claim 1, wherein the sinker bed is engaged by return spring means tending to hold and have the sinker bed returned normally to a lowered position, and the sinker bed is engaged by a raising system to position the sinker bed at the heights between said limit positions.

3. A device according to claim 1, wherein the sinker bed is associated with the cylinder by the interposition of vertical guide elements and wherein the raising system includes thrust struts extending between a lower ring, movable in height and the sinker bed.

4. A device according to claim 3, wherein said vertical guide elements are made up of keys placed between the cylinder and sinker bed or by the needles themselves on the cylinder.

5. A device according to claim 1, further comprising a dial bed placed coaxially above the cylinder and housing other fixtures for knitting of stitches.

6. A circular hosiery and knitting machine comprising:

a rotating cylinder with a cylinder holder, the rotating cylinder being provided with a number of longitudinal grooves;

needle housed respectively in said longitudinal grooves and moving vertically;

rising and lowering cams positioned on a hood around the cylinder to govern the movement of the needles;

a sinker bed placed around the top of the cylinder, turning with the cylinder and holding a number of horizontal sinkers which radially alternate with the vertical needles on the cylinder and which together constitute a formation plane of the stitches on the basis of the rising and lowering of the needles;

rigid anchoring means for anchoring the cylinder to the cylinder holder by the sinker bed being movable in height to several positions between a lowered limit position and a raised limit position, with respect to the cylinder the sinker bed turns with, so as to vary the level of the stitch formation plane defined by the sinkers in relation so the needles on the cylinder.

7. A circular hosiery and knitting machine according to claim 6, wherein the sinker bed is engaged by return spring means for maintaining the sinker bed or for making the sinker bed return normally to the lowered position, and by a raising system to position the sinker bed at a height between said limit positions.

8. A circular hosiery and knitting machine according to claim 7, wherein the sinker bed is associated with the cylinder with the interposition of vertical guide elements, and wherein the raising system includes thrust struts which extend between a lower ring, which is movable in height, and the sinker bed.

9. A circular hosiery and knitting machine according to claim 8, wherein said vertical guide elements are made up of keys placed either between the cylinder and sinker bed or the needles themselves on the cylinder.

10. A circular hosiery and knitting machine according to claim 6, further comprising a dial bed placed coaxially above the cylinder and housing other fixtures for knitting of stitches.

* * * * *